United States Patent [19]

Roberts

[11] Patent Number: 4,976,056

[45] Date of Patent: Dec. 11, 1990

[54] ADVERTISING OR PROMOTIONAL ITEM

[75] Inventor: John L. Roberts, Hertfordshire, United Kingdom

[73] Assignee: Logobugs Limited, Hertfordshire, England

[21] Appl. No.: 356,640

[22] Filed: May 11, 1989

Related U.S. Application Data

[63] Continuation of Ser. No. 89,943, Aug. 26, 1987, abandoned, which is a continuation of Ser. No. 606,414, May 2, 1984, abandoned.

[30] Foreign Application Priority Data

May 13, 1983 [GB] United Kingdom ..... 8313275

[51] Int. Cl.[5] ..... G09F 3/10

[52] U.S. Cl. ..... 40/299; D19/34; D20/22; D20/23; D20/24; D20/25; D20/28; 428/4; 428/16; 428/40

[58] Field of Search ..... 434/83; 428/4, 16, 40; D19/34; D20/22–24, 28; 40/1.5, 299

[56] References Cited

U.S. PATENT DOCUMENTS

| | | | |
|---|---|---|---|
| 3,174,886 | 3/1965 | Miscovich | 428/4 |
| 3,235,986 | 2/1966 | Blish | 40/2 |
| 4,509,280 | 4/1985 | Smith | 428/16 |

FOREIGN PATENT DOCUMENTS

| | | | |
|---|---|---|---|
| 7027246 | of 0000 | Fed. Rep. of Germany . | |
| 1599988 | of 0000 | France . | |
| 589630 | 6/1947 | United Kingdom | 428/4 |

*Primary Examiner*—Pamela R. Schwartz

*Attorney, Agent, or Firm*—Cushman, Darby & Cushman

[57] ABSTRACT

An advertising or promotional item comprises a body (2) from one side of which extends a flag (3) carrying an advertising message, the body (2) having a foot (1) by which it may be adhered to a support. According to the invention the body (2) is a flattened mass of fibers (5), so that the item is small enough to be posted in an envelope in the mail. A face (4) may be adhered to the body (2) to keep the item flat.

16 Claims, 1 Drawing Sheet

ADVERTISING OR PROMOTIONAL ITEM

Figure 1:
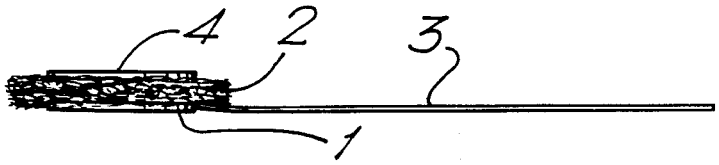

This is a continuation of Application Ser. No. 07,089,943, filed Aug. 26, 1987, now abandoned, which is a continuation of Ser. No. 06/606,414, filed May 2, 1984, now abandoned.

The invention relates to an improved promotional or advertising item. In particular the invention is concerned with such items which comprise a small fluffy body mounted on an adhesive foot and having a tag or flag to one side carrying an advertising message or slogan. Often the body is shaped to simulate a real or mythical object by having eyes, nose, face, antennae or the like, the intention being to make the item more conspicuous and eyecatching, so drawing attention to the advertising message. Such items are known as LOGOBUGS, WEEPLES, WUPPIES, etc.

The item is usually made by stitching or otherwise securing the filaments or fibres of the body together and then fluffing them up to the required size. The fluffing may be done by hand or is more usually done by heating, the effect being to form a sort of pompom. The foot and the slogan is stuck on below, and the face, eyes, etc. on top. These steps may be done in a different sequence. The item then stands about 15 to 35 mm high. The items are usually shipped or mailed in boxes; the cost of postage of packets is high and of course the weight of the packet itself aggravates the cost of postage.

It is an object of this invention to provide an item of the type specified, which can be sent through the post in an envelope, and which will be of a size acceptable even to continental European postal authorities. As a result such items may now be used in direct mailing.

According to one aspect of the invention there is provided an advertising or promotional item comprising at least a fluffy body and an adhesive foot characterised in that the body is dimensioned such that the overall size of the item is sufficiently small to be mailed in an envelope.

In one preferred embodiment, the fibres or filaments or the body are secured together and are fanned out in the absence of heat and by hand pressure only. The foot, flag, etc. are attached, leaving the overall height to be less than say 4 mm. The item and others like it may then be placed in an envelope which will be less than 6 mm or so high and the envelope may then be posted to the continent and it will be acceptable even in France. The overall cost of postage is much reduced.

Because the item can be posted it becomes possible for the first time to direct-mail items of this type as part of an advertising campaign. Most direct mail literature ends up in a waste paper basket but it is believed that an attractive item of this invention will arouse interest. The recipient will simply remove the backing paper so exposing adhesive on the underside of the foot, and then stick the item on to a support, eg. desk, telephone, typewriter or the like. The item may carry on the tag or flag a message promoting eg. a bank, postal, insurance, booksellers or other service and it will be prominently displayed as opposed to most direct mailed literature which, if not discarded, is filed away.

The invention also includes a method of making an item according to the invention, comprising fanning out and flattening a mass of fibres to form a generally flat body portion, adhering a foot portion and a flag portion and, optionally, superimposing a flat face on the body portion to keep the body portion generally flat.

The invention includes a postal envelope containing an advertising or promotional item as disclosed herein.

Figure 2:
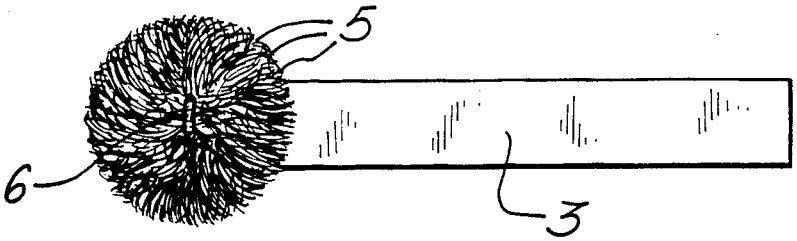

In order that the invention may be well understood, it will now be described with reference to the accompanying diagrammatic drawings, in which FIG. 1 is a side elevation of an item of the invention; and FIG. 2 is a plan view at a stage of manufacture of the item.

The item of FIG. 1 comprises a bug known as a LOGOBUG and having a foot 1, a body portion 2, a flag 3 and a (face) 4. The flag 3 is a length of material on which is printed an advertising message or slogan, e.g. a business name and telephone number or a humorous or cautionary message.

The foot 1 comprises a pad of any suitable shape and material having an adhesive underside. A backing sheet or like cover will usually be present on the underside to protect the adhesive during transport.

The body 2 comprises a number of fibres 5 of acrylic material. These are held together at the centre by a piece of thread or string 6, and in contrast to the treatment of known bodies, instead of being fluffed up to a ball shape by being heated and passed over rollers, they are fanned out in a generally horizontal plane by hand to the flattened wheatsheaf shape shown in FIG. 2. Preferably a (face) 4 is then adhered to the top surface, to keep the body portion generally flat and prevent it from rising to a ball shape. In this way a generally flat bug of reduced height, say about 4 mm high, is formed. This may be posted with other such bugs in an envelope instead of in a heavier and more costly box.

I claim:

1. An advertising or promotional item suitable for direct mailing comprising:

a first, substantially flat element having a top surface, a bottom surface, an adhesive disposed on said bottom surface, and a backing sheet releasibly adhered to said adhesive;

a body portion including a mass of non-woven fibers, said fibers being secured together and said mass being flattened so that the fibers are spread out and extend generally in a horizontal plane so that said body portion has a top surface and a bottom surface, said body portion being secured to said first flat element so that said bottom surface of said body portion is in opposed facing relation to said top surface of said first flat element so that said mass of fibers substantially covers the top surface of said first, flat element;

an elongated flag element having an advertising or promotional message marked thereon, said flag element being secured to said first, flat element and extending outwardly from a side edge thereof; and a second, substantially flat element secured to the top surface of said body portion, said second, flat element maintaining said mass of fibers in said generally flattened disposition.

2. An item as in claim 1, wherein the combination of said first flat element, said body portion and said second flat element has an overall height of less than 4 millimeters.

3. An item as in claim 1, wherein said fibers are acrylic fibers.

4. An item as in claim 1, wherein at least one of said body portion and said second flat element is in the shape of a bug.

5. The item as in claim 1, wherein said first flat element is a pad.

6. An item as in claim 1, wherein a face including eyes and a mouth is defined on said second flat element so that when said second flat element is mounted to said body portion said face is visible.

7. An advertising or promotional item suitable for direct mailing comprising:

a base portion including a substantially flat pad having a top surface and a bottom surface, an adhesive disposed on said bottom surface of said pad, and a backing sheet releasibly adhered to said adhesive;

a body portion including a mass of fibers, said fibers being secured together and flattened so that the fibers are disposed in a substantially horizontal plane so that said body portion has a top surface and a bottom surface, said body portion being secured to said flat pad so that said bottom surface of said body portion is in opposed facing relation to said top surface of said flat pad so that said mass of fibers substantially covers the top surface of said flat pad;

an flag element having a longitudinal axis and first and second longitudinal ends, said first longitudinal end being secured to one of said flat pad and said body portion so that at least a portion of said flag element extends beyond a peripheral edge of said flat pad, at least said portion of said flag element having an advertising or promotional message marked thereon; and a substantially flat element secured to the top surface of said body portion, said flat element maintaining said mass of fibers in said generally flattened disposition.

8. An item as in claim 7, wherein a combination of said flat pad, said body portion, and said flat element has an overall thickness of less than about 4 millimeters.

9. An item as in claim 7, wherein said fibers are acrylic fibers.

10. An items as in claim 7, wherein a face including eyes and a mouth is defined on said flat element so that when said flat element is mounted to said body portion, said face is visible.

11. The combination of a flat postal envelope and an advertising or promotional item suitable for direct mailing disposed with in the flat postal envelope, the item comprising:

a first, substantially flat element having a top surface, a bottom surface, an adhesive disposed on said bottom surface, and a backing sheet releasibly adhered to said adhesive;

a body portion including a mass of non-woven fibers, said fibers being secured together and said mass being flattened so that the fibers are spread out and extend generally in a horizontal plane so that said body portion has a top surface and a bottom surface, said body portion being secured to said first flat element so that said bottom surface of said body portion is in opposed facing relation to said top surface of said first flat element so that said mass of fibers substantially covers the top surface of said first, flat element;

an elongated flag element having an advertising or promotional message marked thereon, said flag element being secured to said first, flat element and extending outwardly from a side edge thereof; and a second, substantially flat element secured to the top surface of said body portion, said second, flat element maintaining said mass of fibers in said generally flattened disposition.

12. The combination of claim 11, wherein said first flat element, said body portion and said second flat element together have an overall height of less than 4 millimeters.

13. The combination of claim 11, wherein said fibers are acrylic fibers.

14. The combination of claim 11, wherein at least one of said body portion and said second flat elements is in the shape of a bug.

15. The combination of claim 11, wherein said first flat element is a pad.

16. The combination of claim 11, wherein a face including eyes and a mouth is defined on said second flat element so that when said second flat element is mounted to said body portion said face is visible.

* * * * *